US007219654B2

(12) United States Patent
Ludwig et al.

(10) Patent No.: US 7,219,654 B2
(45) Date of Patent: May 22, 2007

(54) FUEL INJECTION DEVICE FOR AN INTERNAL COMBUSTION ENGINE

(75) Inventors: Thomas Ludwig, Huenxe (DE); Michael Mennicken, Wimsheim (DE); Andreas Kellner, Tamm (DE); Joachim Boltz, Stuttgart (DE); Falko Bredow, Remseck (DE)

(73) Assignee: Robert Bosch GmbH, Stuttgart (DE)

( * ) Notice: Subject to any disclaimer, the term of this patent is extended or adjusted under 35 U.S.C. 154(b) by 63 days.

(21) Appl. No.: 10/549,458

(22) PCT Filed: Jul. 28, 2004

(86) PCT No.: PCT/DE2004/001690

§ 371 (c)(1),
(2), (4) Date: Sep. 14, 2005

(87) PCT Pub. No.: WO2005/038237

PCT Pub. Date: Apr. 28, 2005

(65) Prior Publication Data

US 2006/0169252 A1 Aug. 3, 2006

(30) Foreign Application Priority Data

Sep. 19, 2003 (DE) ..... 103 43 480

(51) Int. Cl.
*F02M 37/04* (2006.01)

(52) U.S. Cl. ..... 123/446; 123/514

(58) Field of Classification Search ..... 123/446, 123/510, 511, 514
See application file for complete search history.

(56) References Cited

U.S. PATENT DOCUMENTS 4,719,889 A * 1/1988 Amann et al. ..... 123/447
5,983,869 A 11/1999 Cooke et al.
6,234,148 B1 * 5/2001 Hartke et al. ..... 123/447
6,354,272 B1 * 3/2002 Cristiani et al. ..... 123/458
6,609,500 B2 * 8/2003 Ricco et al. ..... 123/446
6,899,085 B2 * 5/2005 Kelly ..... 123/447
6,976,473 B2 * 12/2005 Boos et al. ..... 123/446
7,077,107 B2 * 7/2006 Boos et al. ..... 123/446
7,128,054 B2 * 10/2006 Koehler et al. ..... 123/446
7,156,076 B2 * 1/2007 Holl et al. ..... 123/446

FOREIGN PATENT DOCUMENTS

DE 196 49 139 A1 6/1997
DE 100 02 132 A1 8/2001
EP 0 893 598 A2 1/1999
WO WO 03/008795 A1 1/2003
WO WO 2004/018867 A1 3/2004

* cited by examiner

*Primary Examiner*—Thomas Moulis
(74) *Attorney, Agent, or Firm*—Ronald E. Greigg

(57) ABSTRACT

The fuel injection system has a high-pressure pump that delivers fuel to an accumulator and fuel supply pump delivers fuel to the suction side of the high-pressure pump, with a fuel metering unit between the fuel supply and high-pressure pumps to variably adjust the fuel quantity taken in by the high-pressure pump. The accumulator is connected to at least one fuel injector and a return leads from the fuel injector(s). The fuel return from the injector(s) feeds into the connection between the fuel supply pump and the fuel metering unit. A connection controlled by a pressure valve leads from the fuel return to a discharge region. The high-pressure pump only draws fuel from the fuel return in operating states in which the fuel quantity delivered by the fuel supply pump is less than the required intake quantity of the high-pressure pump.

20 Claims, 3 Drawing Sheets

FUEL INJECTION DEVICE FOR AN INTERNAL COMBUSTION ENGINE

CROSS-REFERENCE TO RELATED APPLICATIONS

This application is a 35 USC 371 application of PCT/DE 2004/001690 filed on Jul. 28, 2004.

BACKGROUND OF THE INVENTION

1. Field of the Invention

The invention is directed to an improved fuel injection system for an internal combustion engine.

2. Description of the Prior Art

A fuel injection system of the type with which this invention is cornered, known from DE 100 02 132 A1, has a high-pressure pump that delivers fuel to an accumulator. A fuel supply pump delivers fuel from a fuel tank to the suction side of the high-pressure pump, and a fuel metering unit between the fuel supply pump and the high-pressure pump can variably adjust the quantity of fuel taken in by the high-pressure pump. The accumulator is connected to at least one injector that injects fuel into the internal combustion engine. A fuel return leads from the injector back to the fuel tank. In order to assure that the high-pressure pump delivers a sufficient supply of fuel to the accumulator in all operating states of the engine, the fuel supply pump must deliver a sufficiently large quantity of fuel to the high-pressure pump. But in order to achieve this, it becomes necessary to provide a fuel supply pump with very large dimensions, which increases the weight and amount of space required of the fuel injection system and also contributes to high manufacturing costs.

SUMMARY AND ADVANTAGES OF THE INVENTION

The fuel injection system according to the present invention has the advantage over the prior art that the fuel supply pump can be of relatively small dimensions, which makes it possible to minimize the space required, weight, and costs of the fuel injection system. Only when the quantity of fuel delivered by the fuel supply pump is less than the required intake quantity of the high-pressure pump does the high-pressure pump also take in additional fuel from the fuel return. This assures that the high-pressure pump takes in predominantly the cool fuel delivered by the fuel supply pump and only the shortfall is made up by the heated fuel from the fuel return.

Advantageous embodiments and modifications of the fuel injection system according to the present invention are disclosed. One embodiment assures that the high-pressure pump will only take in fuel from the fuel return if the fuel quantity delivered by the fuel supply pump falls short of the required intake quantity. Another embodiment provides for a lubrication and cooling of the drive region of the high-pressure pump while still another assures that the drive region of the high-pressure pump is supplied exclusively with fuel delivered by the fuel supply pump, i.e. cooler fuel. In a further embodiment only the fuel quantity taken in by the high-pressure pump passes through the filter, thus allowing a smaller or simpler filter design to be used.

BRIEF DESCRIPTION OF THE DRAWINGS

A number of exemplary embodiments of the present invention are explained in greater detail in the subsequent description, taken in conjunction with the drawings, in which.

DESCRIPTION OF THE PREFERRED EMBODIMENTS

Figure 1:
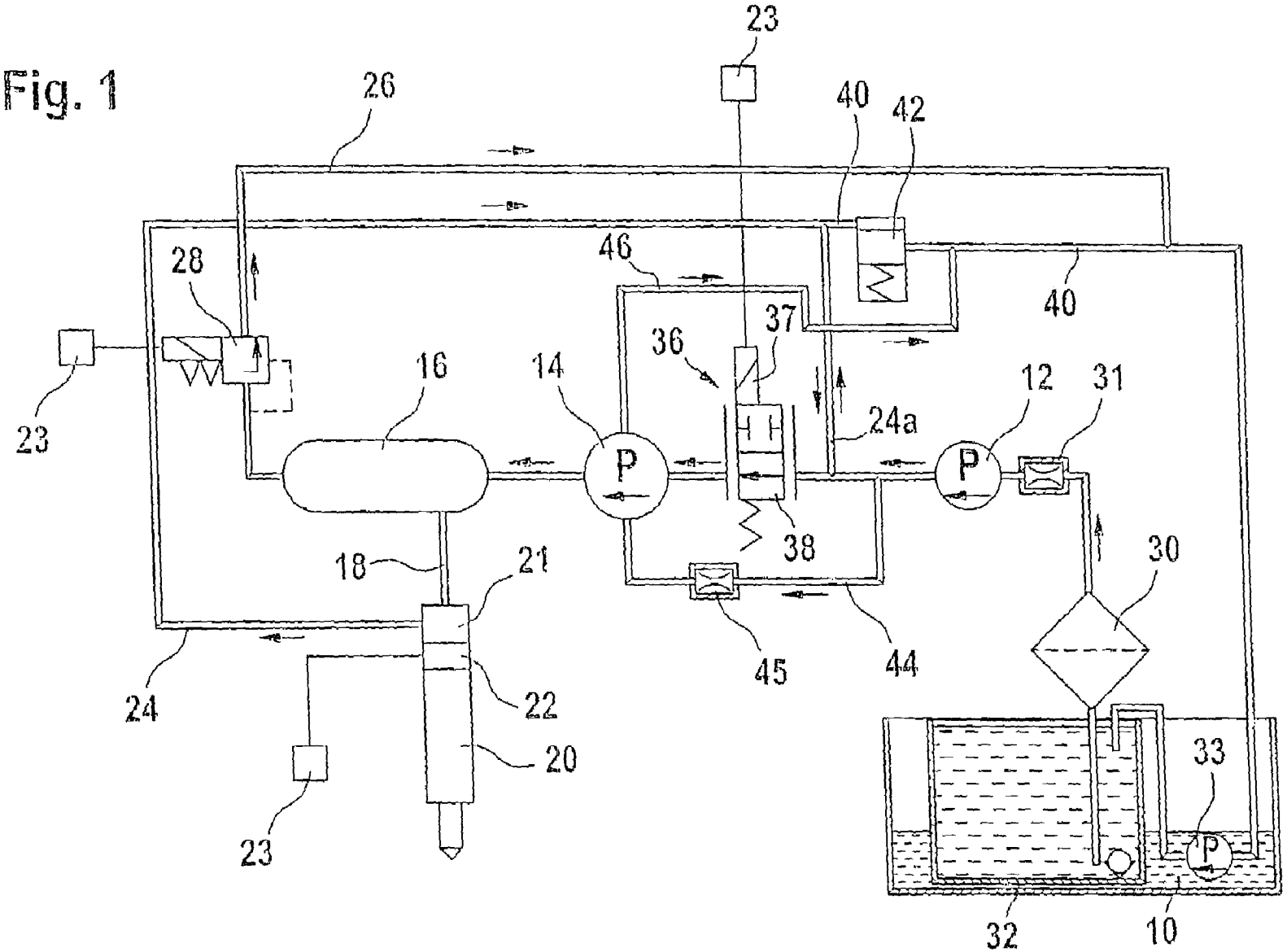
FIG. 1 is a schematic depiction of a first exemplary embodiment of a fuel injection system for an internal combustion engine according to the invention.
Figure 2:
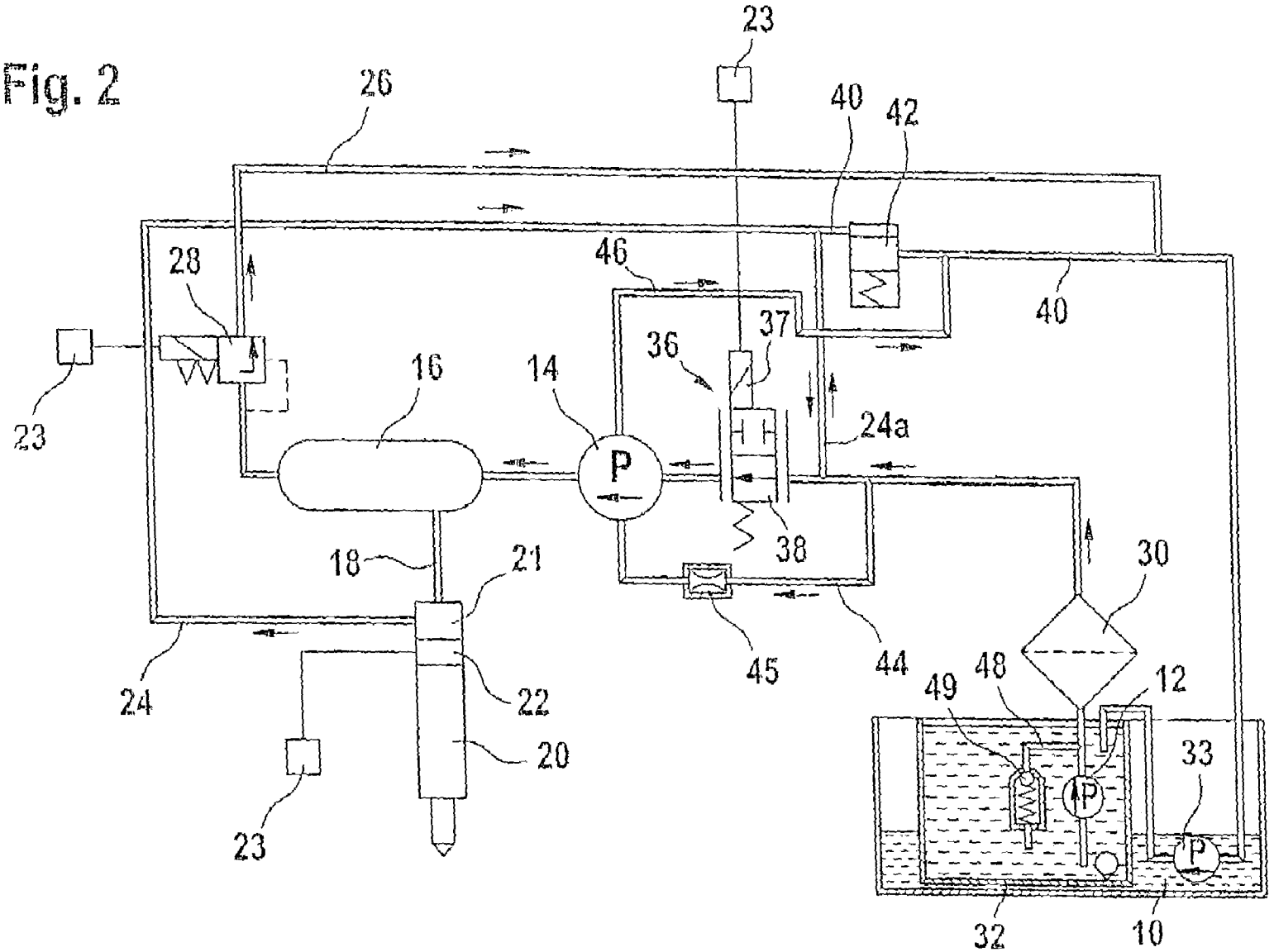
FIG. 2 shows the fuel injection system according to a second exemplary embodiment.
Figure 3:
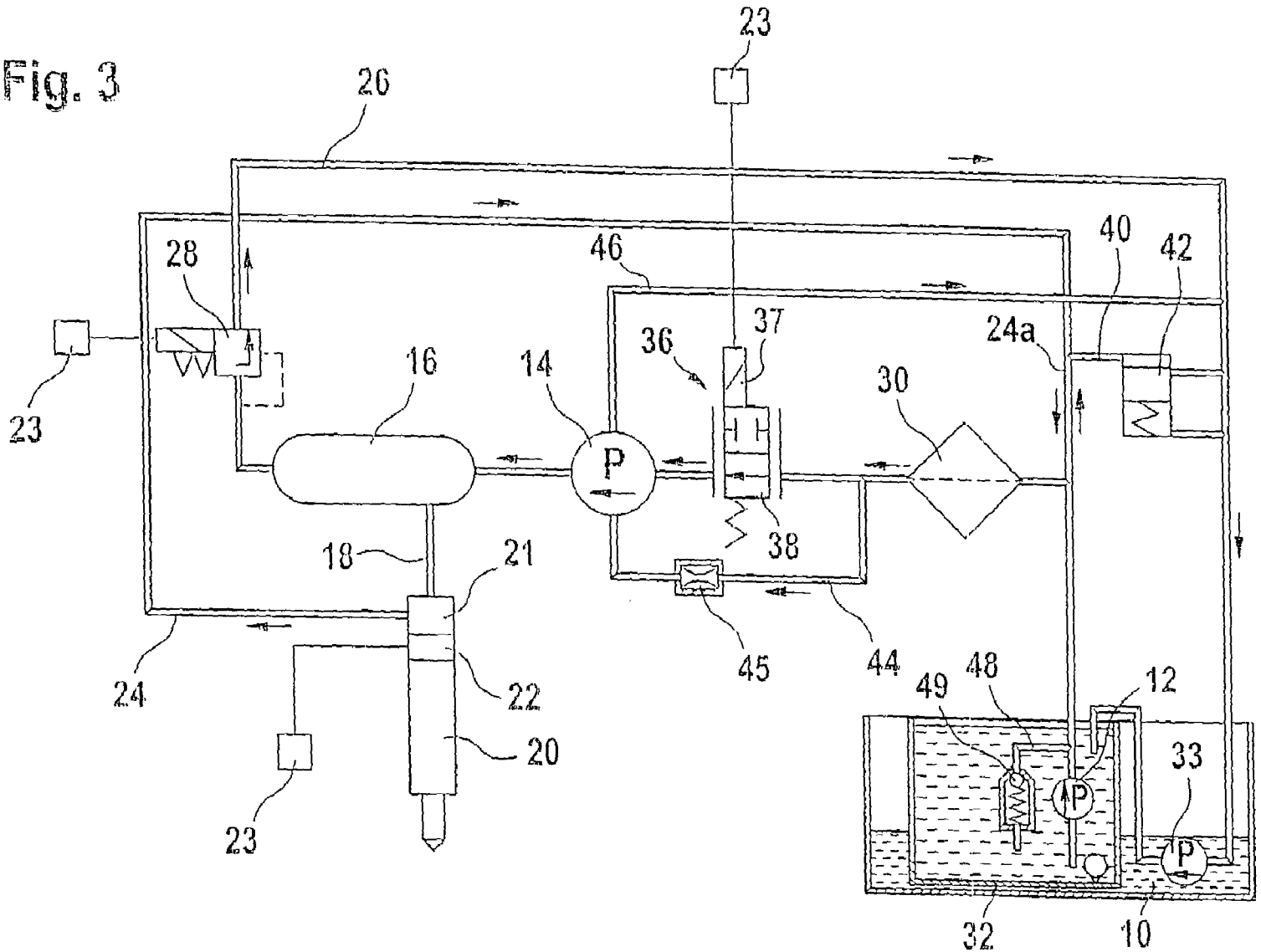
FIG. 3 shows the fuel injection system according to a third exemplary embodiment.

FIGS. 1 to 3 show a fuel injection system for an internal combustion engine, for example of a motor vehicle. The engine is an autoignition internal combustion engine, for example, and has one or more cylinders. The motor vehicle has a fuel tank 10 that stores fuel for the operation of the engine. The fuel injection system has a fuel supply pump 12 that delivers fuel from the fuel tank 10 to a high-pressure pump 14. The high-pressure pump 14 delivers fuel to an accumulator 16 that can be embodied, for example, in the form of a tube or in any other shape. At least one line 18 leads from the accumulator 16 to at least one injector 20 associated with a cylinder of the engine; preferably, the accumulator 16 is connected to a number of injectors 20. Each of the injectors 20 is provided with an electric control valve 22 that controls at least one opening of the respective injector in order to trigger or prevent a fuel injection through the injector 20. An electronic control unit 23 triggers the control valves 22 and, as a function of operating parameters of the engine such as engine speed, load, temperature, etc., determines the time and duration of the fuel injection through the injectors 20. A fuel return for unused fuel leads back from the injectors 20, for example via a line 24 that is shared by all of the injectors 20. A line 26 functioning as a return can also lead from the accumulator 16 back to the fuel tank 10, which line contains a pressure-limiting valve or pressure control valve 28 that prevents an impermissibly high pressure from building up in the accumulator 16 and can vary the pressure prevailing in the accumulator 16. Between the accumulator 16 and the injectors 20, a pressure boosting device 21 can be provided, which further increases the pressure available for fuel injection in comparison to the pressure prevailing in the accumulator 16. The pressure boosting device 21 is preferably integrated into the injector 20 and is embodied in the form of a hydraulic pressure booster. In this case, the fuel return 24 preferably leads from the pressure booster 21 of the injectors 20.

The high-pressure pump 14 is mechanically driven by the internal combustion engine and is therefore driven in proportion to the speed of the engine. In a first exemplary embodiment shown in FIG. 1, the fuel supply pump 12 is likewise mechanically driven by the engine or the high-pressure pump 14. In this case, the fuel supply pump 12 is preferably mounted onto the high-pressure pump 14 or integrated into it. A filter 30 is provided between the fuel supply pump 12 and the fuel tank 10. In addition, a throttle restriction 31 can be provided in the connection between the fuel supply pump 12 and the fuel tank 10 in order to limit the flow. The fuel tank 10 can contain a collecting reservoir 32 from which the fuel supply pump 12 draws fuel and into which a jet pump 33 delivers fuel from the fuel tank 10. The motive flow of the jet pump 33 is supplied to it from the accumulator 16 via the fuel return 26.

The high-pressure pump 14 can be embodied in the form of a radial piston pump and has at least one and possibly several pump elements, each of which has a pump piston that delimits a pump working chamber and is driven into a reciprocating motion by drive shaft. A fuel metering unit 36 is provided between the fuel supply pump 12 and the high-pressure pump 14. The fuel metering unit 36 has a control valve 38 that is actuated, for example, by an electric actuator 37, preferably an electromagnet or a piezoelectric actuator, and can continuously adjust the flow from the fuel supply pump 12 to the high-pressure pump 14. The control valve 38 can be embodied in the form of a proportional valve that can continuously change the flow cross section between the fuel supply pump 12 and high-pressure pump 14. Alternatively, the control valve 38 can also be opened and closed cyclically, which makes it possible to change an average effective flow cross section between the fuel supply pump 12 and the high-pressure pump 14. The fuel metering unit 36 is preferably mounted onto the high-pressure pump 14 or integrated into it, but can also be disposed separate from the high-pressure pump 14. The control unit 23 triggers the fuel metering unit 36 in such a way that the fuel supply pump 12 delivers a fuel quantity to the high-pressure pump 14 that the high-pressure pump 14 then in turn delivers at high pressure to the accumulator 16 in order to maintain a predetermined pressure in the accumulator 16 as a function of operating parameters of the internal combustion engine. The accumulator 16 is associated with a pressure sensor in the pressure control valve that is connected to the control unit 23 and supplies it with a signal indicating the current pressure in the accumulator 16.

The fuel return 24 from the injectors 20 feeds into the connection between the fuel supply pump 12 and the fuel metering unit 36. A connection 40 controlled by a pressure valve 42 leads from the fuel return 24 to a discharge region that can be comprised, for example, of the fuel tank 10. The pressure valve 42 opens the connection 40 when a predetermined pressure is exceeded so that fuel can flow out into the fuel tank 10. The connection 40 can feed into the return line 26 from the accumulator 16 so that the fuel quantity diverted via the pressure valve 42 is also supplied to the jet pump 33 as a motive flow. The pressure valve 42 is preferably mounted onto the high-pressure pump 14 or integrated into it. The connection 40 branches off from the fuel return 24 spaced apart from its outlet into the connection between the fuel supply pump 12 and the fuel metering unit 36, thus yielding a fuel return segment 24*a* that extends between the outlet and the branching-off point of the connection 40.

From the connection between the fuel supply pump 12 and the fuel metering unit 36, in a region between the fuel supply pump 12 and the outlet of the fuel return segment 24*a*, a bypass connection 44 branches off to a drive region of the high-pressure pump 14. The drive region of the high-pressure pump 14 referred to here includes its drive shaft as well as the region in which the rotary motion of the drive shaft is converted into the reciprocating motion of the pump pistons. The fuel flowing via the bypass line 44 into the drive region assures a lubrication and cooling of the drive region. The bypass connection 44 preferably contains a throttle restriction 45 to limit the fuel quantity supplied to the drive region. A return 46 leads from the drive region of the high-pressure pump 14 back to the fuel tank 10 and can feed, for example, into the connection 40 and the return 26 from the accumulator 16. The return 46 assures a constant flow through the drive region of the high-pressure pump 14.

The function of the fuel injection system according to the first exemplary embodiment will be explained below. During operation of the internal combustion engine, the fuel supply pump 12 draws fuel from the fuel tank 10 and delivers it via the fuel metering unit 36 to the suction side of the high-pressure pump 14. The high-pressure pump 14 delivers fuel at high pressure to the accumulator 16. The injectors 20 inject fuel into the cylinders of the engine and the control unit 23 determines the timing of the fuel injection and the quantity of injected fuel by triggering the control valves 22 as a function of operating parameters of the engine. The control unit 23 also triggers the fuel metering unit 36 so that it sets a flow cross section great enough that the high-pressure pump 14 draws and delivers to the accumulator 16 the fuel quantity required to maintain a predetermined pressure in the accumulator 16.

Particularly if the injectors 20 are provided with pressure boosters 21, depending on the operating state of the engine, the high-pressure pump 14 must deliver a large quantity of fuel to the accumulator 16 and the fuel supply pump 12 must deliver this large quantity of fuel from the fuel tank 10 to the high-pressure pump 14. This can require that the fuel supply pump 12 be designed with very large dimensions. According to the present invention, however, the fuel supply pump 12 is dimensioned so that the maximum quantity of fuel it can deliver is less than the maximum quantity of fuel that the high-pressure pump 14 must take in and deliver to the accumulator 16. In operating states in which the quantity of fuel that the fuel supply pump 12 delivers from the fuel tank 10 is insufficient, the high-pressure pump 14 takes in part of the fuel quantity flowing from the injectors 20 through the fuel return 24 in addition to the quantity of fuel delivered by the fuel supply pump 12. In the process of this, part of the fuel flowing through the fuel return 24 flows out through the fuel return segment 24*a* into the connection between the fuel supply pump 12 and the fuel metering unit 36 and is taken in by the high-pressure pump 14. The remaining part of the quantity of fuel flowing through the fuel return 24 flows through the open pressure valve 42, via the connection 40, and into the fuel tank 10. The quantity of fuel flowing into the drive region via the bypass line 44 is thus exclusively drawn from the quantity of fuel that the fuel supply pump 12 delivers from the fuel tank 10 and is therefore relatively cool. The fuel quantity taken in by the high-pressure pump 14 is likewise relatively cool since only part of this fuel quantity is drawn from the heated fuel return 24.

In operating states in which the fuel quantity that the fuel supply pump 12 delivers from the fuel tank 10 is sufficient to supply the required intake quantity of the high-pressure pump 14, the high-pressure pump 14 only takes in fuel delivered by the fuel supply pump 12 and the entire quantity of fuel flowing through the fuel return 24 is conveyed through the open pressure valve 42, via the connection 40, and into the fuel tank 10. In operating states in which the fuel supply pump 12 delivers a quantity of fuel greater than the required intake quantity of the high-pressure pump 14, part of the fuel quantity delivered by the fuel supply pump 12 is conveyed back through the fuel return segment 24*a* and through the open pressure valve 42, via the connection 40, and likewise into the fuel tank 10. In these operating states, the high-pressure pump 14 consequently only takes in the relatively cool fuel quantity delivered by the fuel supply pump 12.

The fuel flows through the fuel return segment 24*a* in different directions depending on the operating state. If the quantity of fuel delivered by the fuel supply pump 12 is less than the required intake quantity of the high-pressure pump 14, then a partial quantity of the fuel quantity flowing back from the injectors 20 through the fuel return 24 flows through the fuel return segment 24*a* in the direction toward the high-pressure pump 14. If the quantity of fuel delivered by the fuel supply pump 12 is greater than the required intake quantity of the high-pressure pump 14, then a partial quantity of the fuel quantity delivered by the fuel supply pump 12 flows through the fuel return segment 24*a* in the direction toward the pressure valve 42. The fuel return segment 24*a* thus assures that when the delivery quantity of the fuel supply pump 12 is sufficient, the high-pressure pump 14 only takes in fuel delivered by the fuel supply pump 12 and only when the delivery quantity of the fuel supply pump 12 is insufficient, does the high-pressure pump 14 also take in fuel from the fuel return 24. Only the fuel quantity delivered by the fuel supply pump 12 flows through the filter 30, whereas the fuel quantity drawn from the fuel return 24 is not introduced until after the filter 30. But the excess fuel potentially delivered by the fuel supply pump 12 and diverted via the fuel return segment 24*a*, the pressure valve 42, and the connection 40 also flows through the filter 30.

FIG. 2 shows the fuel injection system according to a second exemplary embodiment in which the fundamental design is the same as in the first exemplary embodiment and only the fuel supply pump 12 has been modified. The fuel supply pump 12 is disposed separate from the high-pressure pump 14, has an electric drive unit, and is preferably disposed inside the fuel tank 10. The filter 30 is provided between the fuel supply pump 12 and the fuel metering unit 36; the bypass connection 44 to the drive region of the high-pressure pump 14 branches off between the filter 30 and the fuel metering unit 36. Inside the fuel tank 10, a return 48 that leads back into the fuel tank 10 and is controlled by a pressure valve 49 branches off from the connection of the fuel supply pump 12 to the filter 30. The pressure valve 49 and the return 48 limit the pressure between the fuel supply pump 12 and the filter 30, thus preventing an impermissible increase in pressure if the filter 30 becomes clogged, for example. The remainder of the design and function of the fuel injection system according to the second exemplary embodiment is the same as in the first exemplary embodiment described above.

FIG. 3 shows the fuel injection system according to a third exemplary embodiment in which the fundamental design is the same as in the second exemplary embodiment, but the disposition of the pressure valve 42 and the fuel return segment 24*a* has been modified. The fuel supply pump 12 has an electric drive unit and is disposed in the fuel tank 10. The bypass connection 44 leading to the drive region of the high-pressure pump 14 branches off between the filter 30 and fuel metering unit 36. The fuel return 24 from the injectors 20 feeds into the connection between the fuel supply pump 12 and the filter 30. The connection 40 controlled by the pressure valve 42 leads from the fuel return 24 to the fuel tank 10. The fuel return segment 24*a* is disposed between the branch-off point of the connection 40 and the outlet of the fuel return 24 into the connection between the fuel supply pump 12 and the filter 30. In the third exemplary embodiment, the pressure valve 42 can be disposed separate from the high-pressure pump 14.

The function of the fuel injection system according to the third exemplary embodiment is essentially the same as in the first and second exemplary embodiments. Fuel flows through the fuel return segment 24*a* in different directions depending on the operating state. If the fuel quantity delivered by the fuel supply pump 12 is less than the required intake quantity of the high-pressure pump 14, then a partial quantity of the fuel quantity flowing from the injectors 20 through the fuel return 24 flows through the fuel return segment 24*a* in the direction toward the high-pressure pump 14. If the fuel quantity delivered by the fuel supply pump 12 is greater than the required intake quantity of the high-pressure pump 14, then a partial quantity of the fuel quantity delivered by the fuel supply pump 12 flows through the fuel return segment 24*a* in the direction toward the pressure valve 42. The fuel return segment 24*a* thus assuring that if the delivery quantity of the fuel supply pump 12 is sufficient, then the high-pressure pump 14 exclusively takes in fuel delivered by the fuel supply pump 12 and only if the delivery quantity of the fuel supply pump 12 is insufficient, does the high-pressure pump 14 also take in fuel from the fuel return 24. By contrast with the first and second exemplary embodiments, in the third exemplary embodiment, the entire quantity of fuel taken in by the high-pressure pump 14 flows through the filter 30. The excess fuel potentially delivered by the fuel supply pump 12, however, does not flow through the filter 30 because it is diverted via the fuel return segment 24*a*, the pressure valve 42, and the connection 40 before reaching the filter 30. Only with a sufficient delivery quantity of the fuel supply pump 12 is the fuel quantity delivered to the drive region of the high-pressure pump 14 via the bypass connection 44 diverted exclusively from the cold fuel supply that the fuel supply pump 12 delivers from the fuel tank 10. When the delivery quantity of the fuel supply pump 12 is insufficient, the fuel quantity delivered to the drive region is drawn from the mixture of the cold fuel that the fuel supply pump 12 delivers from the fuel tank 10 and the heated fuel taken from the fuel return 24. By contrast with the first and second exemplary embodiments, in the third exemplary embodiment, when the delivery quantity of the fuel supply pump 12 is insufficient, the drive region of the high-pressure pump 14 is consequently supplied with fuel at a slightly higher temperature.

The foregoing relates to preferred exemplary embodiments of the invention, it being understood that other variants and embodiments thereof are possible wherein the spirit and scope of the invention, the latter being defined by the appended claims.

The invention claimed is:

1. A fuel injection system for an internal combustion engine, the system comprising a high-pressure pump that delivers fuel at high pressure to an accumulator, a fuel supply pump that delivers fuel to the suction side of the high-pressure pump, a fuel metering unit connected between the fuel supply pump and the high-pressure pump and operable to variably adjust the fuel quantity taken in by the high-pressure pump, at least one injector connected to the accumulator for injecting fuel into the engine, a fuel return from the at least one injector, the fuel return from the at least one injector feeding into the connection between the fuel supply pump and the fuel metering unit, and a connection controlled by a pressure valve leading from the fuel return to a discharge region, the high-pressure pump only drawing fuel from the fuel return in operating states in which the fuel quantity delivered by the fuel supply pump is less than the required intake quantity of the high-pressure pump.

2. The fuel injection system according to claim 1, wherein the high-pressure pump draws from the fuel return only the difference between its required intake quantity and the fuel quantity delivered by the fuel supply pump.

3. The fuel injection system according to claim 1, wherein the branch-off point of the connection leading from the fuel return to the discharge region is disposed spaced apart from the outlet of the fuel return into the connection between the fuel supply pump and the fuel metering unit, which spacing yields a fuel return segment between the outlet of the fuel return and the branch-off point of the connection leading to the discharge region.

4. The fuel injection system according to claim 2, wherein the branch-off point of the connection leading from the fuel return to the discharge region is disposed spaced apart from the outlet of the fuel return into the connection between the fuel supply pump and the fuel metering unit, which spacing yields a fuel return segment between the outlet of the fuel return and the branch-off point of the connection leading to the discharge region.

5. The fuel injection system according to claim 1, further comprising a bypass line to a drive region of the high-pressure pump branches off from the connection between the fuel supply pump and the fuel metering unit.

6. The fuel injection system according to claim 2, further comprising a bypass line to a drive region of the high-pressure pump branches off from the connection between the fuel supply pump and the fuel metering unit.

7. The fuel injection system according to claim 3, further comprising a bypass line to a drive region of the high-pressure pump branches off from the connection between the fuel supply pump and the fuel metering unit.

8. The fuel injection system according to claim 4, further comprising a bypass line to a drive region of the high-pressure pump branches off from the connection between the fuel supply pump and the fuel metering unit.

9. The fuel injection system according to claim 5, wherein between the fuel metering unit and the branch-off point of the bypass connection, the fuel return feeds into the connection between the fuel supply pump and the fuel metering unit.

10. The fuel injection system according to claim 6, wherein between the fuel metering unit and the branch-off point of the bypass connection, the fuel return feeds into the connection between the fuel supply pump and the fuel metering unit.

11. The fuel injection system according to claim 7, wherein between the fuel metering unit and the branch-off point of the bypass connection, the fuel return feeds into the connection between the fuel supply pump and the fuel metering unit.

12. The fuel injection system according to claim 5, wherein between the fuel supply pump and the branch-off point of the bypass line, the fuel return feeds into the connection between the fuel supply pump and the fuel metering unit.

13. The fuel injection system according to claim 6, wherein between the fuel supply pump and the branch-off point of the bypass line, the fuel return feeds into the connection between the fuel supply pump and the fuel metering unit.

14. The fuel injection system according to claim 7, wherein between the fuel supply pump and the branch-off point of the bypass line, the fuel return feeds into the connection between the fuel supply pump and the fuel metering unit.

15. The fuel injection system according to claim 1, wherein the suction side of the fuel supply pump is preceded by a filter and/or the pressure side of the fuel supply pump is followed by a filter and, downstream of the filter, the fuel return feeds into the connection between the fuel supply pump and the fuel metering unit.

16. The fuel injection system according to claim 1, wherein the suction side of the fuel supply pump is preceded by a filter and/or the pressure side of the fuel supply pump is followed by a filter and, upstream of the filter, the fuel return feeds into the connection between the fuel supply pump and the fuel metering unit.

17. The fuel injection system according to claim 3, wherein the suction side of the fuel supply pump is preceded by a filter and/or the pressure side of the fuel supply pump is followed by a filter and, upstream of the filter, the fuel return feeds into the connection between the fuel supply pump and the fuel metering unit.

18. The fuel injection system according to claim 1, wherein the fuel supply pump has an electric drive unit.

19. The fuel injection system according to claim 1, wherein the fuel supply pump is mechanically driven by the internal combustion engine or by the high-pressure pump.

20. The fuel injection system according to claim 1, wherein the at least one injector has a pressure boosting unit disposed on it, from which the fuel return leads.

* * * * *